US006530118B2

(12) United States Patent
Oh

(10) Patent No.: US 6,530,118 B2
(45) Date of Patent: Mar. 11, 2003

(54) SUB-SUCTION PIPE ASSEMBLY FOR VACUUM CLEANER

(75) Inventor: Jang-keun Oh, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 28 days.

(21) Appl. No.: 09/834,681

(22) Filed: Apr. 12, 2001

(65) Prior Publication Data

US 2002/0053114 A1 May 9, 2002

(30) Foreign Application Priority Data

Nov. 6, 2000 (KR) ..... 2000-65659
Nov. 10, 2000 (KR) ..... 2000-66865
Nov. 21, 2000 (KR) ..... 2000-69332

(51) Int. Cl.[7] ..... A47L 7/00; A47L 9/02; A47L 5/00; A47L 9/00

(52) U.S. Cl. ..... 15/414; 15/415.1; 15/393; 15/398; 15/400; 15/377; 15/363; 15/364; 15/365; 15/328; 15/327.1; 287/7; 287/145.1

(58) Field of Search ..... 15/414, 415.1, 15/393, 398, 400, 377, 363, 364, 365, 328, 327.1; 287/7, 145.1

(56) References Cited

U.S. PATENT DOCUMENTS 2,351,507 A * 6/1944 Hallock ..... 15/327.7
3,574,885 A * 4/1971 Jones ..... 119/632
4,793,646 A * 12/1988 Michaud, Jr. ..... 114/221 R
5,579,557 A * 12/1996 Boden ..... 15/144.4
5,768,745 A * 6/1998 Lee ..... 15/373
5,839,161 A * 11/1998 Liang ..... 15/393
5,951,781 A * 9/1999 Lucas ..... 134/6
5,970,577 A * 10/1999 Kim ..... 15/398

* cited by examiner

*Primary Examiner*—Robert J. Warden, Sr.
*Assistant Examiner*—Shay Balsis
(74) *Attorney, Agent, or Firm*—Westman, Champlin & Kelly, P.A.

(57) ABSTRACT

A sub-suction pipe assembly for a vacuum cleaner includes an air suction pipe connected to a vacuum cleaner body, a sub-suction pipe connected to the air suction pipe and movable along the air suction pipe between a first position and a second position. The sub-suction pipe has a brush attached to an end thereof, a suction extension pipe detachably connected to the end of the air suction pipe, and a lock mechanism for securing the suction extension pipe to the air suction pipe. The sub-section pipe remains coupled to the end of the air suction pipe when the suction extension pipe is connected to the air suction pipe.

15 Claims, 13 Drawing Sheets

SUB-SUCTION PIPE ASSEMBLY FOR VACUUM CLEANER

BACKGROUND OF THE INVENTION

1. Field of the Invention

The present invention relates to a sub-suction pipe assembly for a vacuum cleaner.

2. Description of the Prior Art

Generally, as shown in FIG. 1, a vacuum cleaner, such as a canister vacuum cleaner, includes a suction brush 3, which is connected to a body 1 of the vacuum cleaner. The suction brush 3 moves along a cleaning surface during a cleaning operation. The body 1 of the vacuum cleaner is divided into a dust collecting chamber, which houses a dust filter or the like, and a motor driving chamber, which houses a motor for generating a suction force. Further, the cleaner body 1 is connected to an air suction pipe 6, which includes a flexible hose 4 and a handle 5. The handle 5 of the air suction pipe 6 is detachably connected to a suction extension pipe 7, which in turn is connected to the suction brush 3.

When cleaning a large area such as a floor of a living room, hallway, etc., the suction extension pipe 7 is connected to the handle 5. The suction extension pipe 7 can be removed from the handle 5 and replaced with a smaller, sub-section pipe 9 to clean smaller areas, such as a desk, table, etc. The sub-suction pipe 9 has a brush 9*a*, which is mounted at one end thereof, for passing across a smaller surface area. Accordingly, in order to use the suction extension pipe 7, after cleaning with the brush 9*a* of the sub-section pipe 9, the sub-suction pipe 9 must first be detached from the handle 5. When removed from the handle 5, the sub-suction pipe 9 must be stored in a separate place.

Since the sub-suction pipe 9 is stored separate from the vacuum cleaner body 1, the sub-suction pipe 9 is often lost. This results in an inconvenience to a user, as the user must first find the sub-suction pipe 9 in order to use it. As a result, the sub-suction pipe 9 may not be readily accessible to the user when needed.

Another inconvenience that a separately stored sub-suction pipe 9 creates for the user is that user must switch back and forth between connecting and disconnecting the extension pipe 7 and the sub-suction pipe 9 to and from the handle 5 when cleaning large and small surface areas.

SUMMARY OF THE INVENTION

The present invention has been made to overcome the above-problems of the prior art. Accordingly, it is an object of the present invention to provide a sub-suction pipe assembly for a vacuum cleaner that has an improved structure, which facilitates exchange between the sub-suction pipe and suction extension pipe.

The above object is accomplished by a sub-suction pipe assembly for a vacuum cleaner that includes an air suction pipe connected to a vacuum cleaner body, and a sub-suction pipe movably connected to the air suction pipe and movable with respect to an end of the air suction pipe. The sub-suction pipe includes a brush attached to an end thereof. The sub-suction pipe assembly further includes a suction extension pipe detachably connected to the air suction pipe and locking/unlocking means for locking and unlocking the suction extension pipe with respect to the air suction pipe.

The locking/unlocking means includes a plate spring disposed in the suction extension pipe, a locking hole, a release button and a spring. The plate spring has a locking protrusion protruding from an outer wall of the suction extension pipe through a passing hole formed therein. The locking hole is formed in the air suction pipe to receive the locking protrusion. The release button, which is mounted on the sub-section pipe, removes the locking protrusion from the locking hole. The release button is biased away from the locking hole by the spring.

An aligning means is further provided for aligning the locking hole with the locking protrusion when connecting the suction extension pipe to the air suction pipe. The aligning means includes an alignment groove formed lengthwise in an inner wall of the air suction pipe, and an alignment protrusion extending from the outer wall of the suction extension pipe. The alignment groove receives the alignment protrusion when the suction extension pipe is aligned with and inserted into the air suction pipe.

A rotation preventing means is further provided for guiding the sub-suction pipe along the air suction pipe and preventing rotation of the sub-suction pipe. The rotation preventing means includes a guide protrusion protruding from the outer wall of the air suction pipe, and a guide groove formed in the inner wall of the sub-suction pipe.

The sub-suction pipe includes an elastic connecting portion connected to the outer wall of the air suction pipe. The elastic connecting portion generates a friction force between the air suction pipe to restrict movement of the air suction pipe. The elastic connecting portion includes a protrusion that is received in one of a plurality of inserting holes formed in the outer wall of the air suction pipe.

The ends of the sub-suction pipe and the brush are at a predetermined angle with respect to a central axis of the sub-suction pipe.

The air suction pipe includes a handle portion having a pipe type connecting portion, which is movably connected to the sub-suction pipe, and a flexible hose portion connecting the handle and the cleaner body.

The locking/unlocking means includes a plate spring disposed in the suction extension pipe. The plate spring has a locking protrusion protruding from the outer wall of the suction extension pipe through the passing hole formed therein. A locking hole is formed in the air suction pipe for receiving the locking protrusion when the suction extension pipe is connected to the air suction pipe, and an elastically deformable elastic portion is disposed between the air suction pipe and the sub-suction pipe. The elastic portion has a release protrusion that is selectively inserted in the locking hole to disengage the locking protrusion from the locking hole.

The sub-suction pipe has a sloping groove formed lengthwise along an inner wall of the sub-suction pipe at a predetermined angle, and the elastic portion of the locking/unlocking means is elastically deformed by the sloping groove as the sub-suction pipe moves with respect to the air suction pipe.

Each of the air suction pipe and the sub-suction pipe includes a locking elevation for engagement with each other to restrict movement and separation of the sub-suction pipe from the air suction pipe.

BRIEF DESCRIPTION OF THE DRAWINGS

The above and other objects and advantages of the present invention will become readily apparent by reference to the following detailed description when considered in conjunction with the accompanying drawings, in which.

DESCRIPTION OF THE PREFERRED EMBODIMENTS

Figure 2:
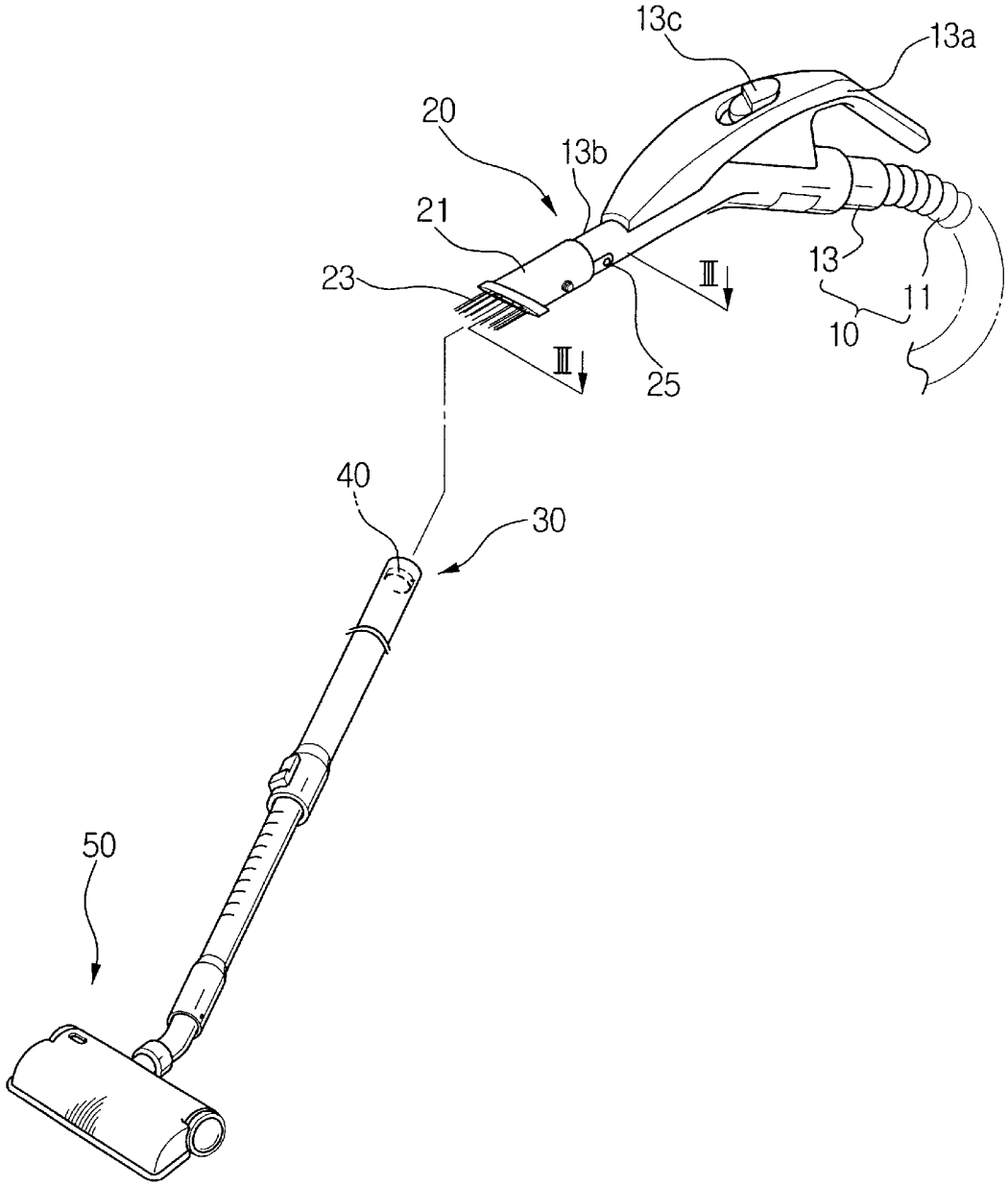
FIG. 2 is an exploded perspective view of a sub-suction pipe assembly for a vacuum cleaner in accordance with the present invention.

As shown in FIG. 2, in accordance with one preferred embodiment of the present invention, a sub-suction pipe assembly for a vacuum cleaner includes an air suction pipe 10, a sub-suction pipe 20 movably connected to an end of the air suction pipe 10, a suction extension pipe 30, and a locking/unlocking means.

Figure 1:
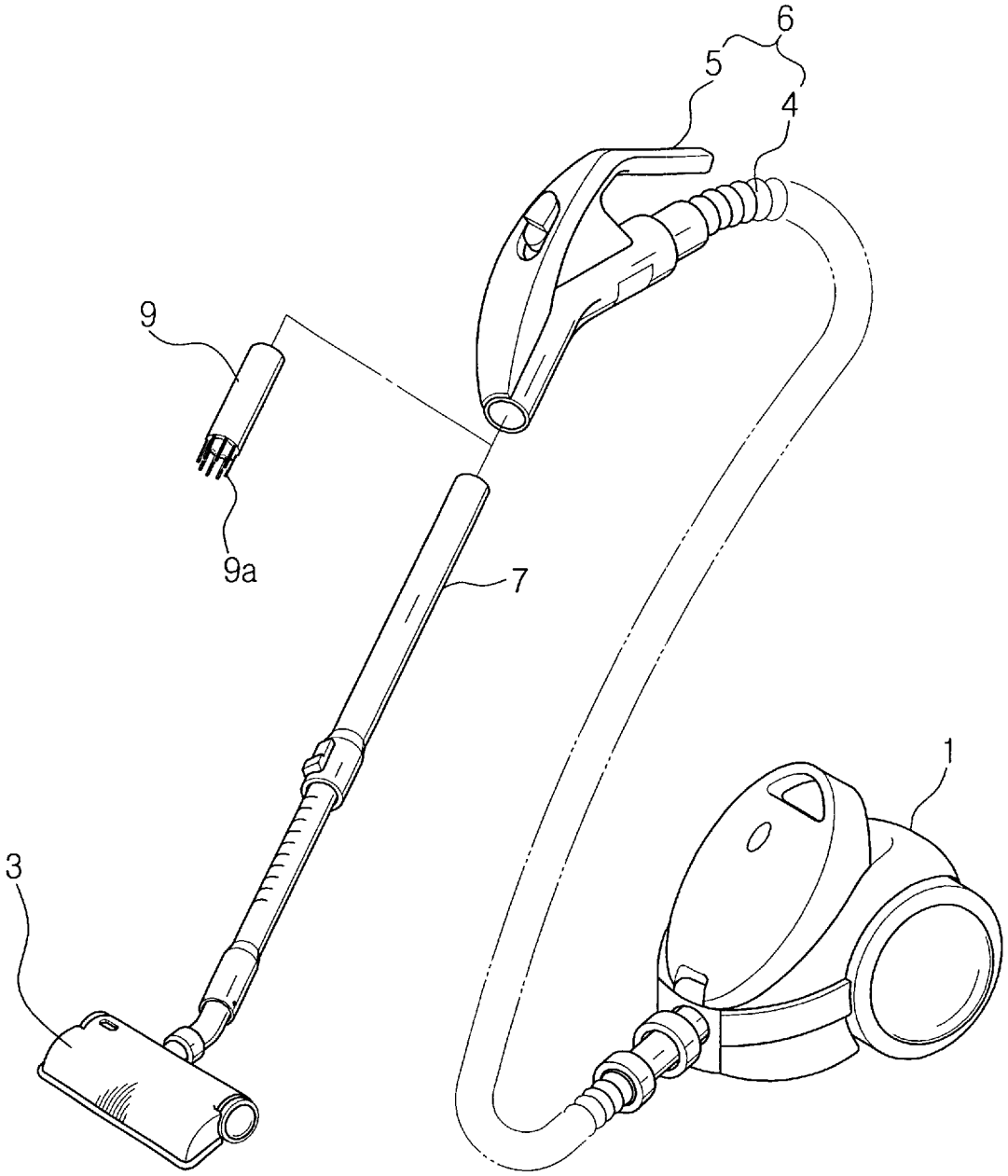
FIG. 1 (PRIOR ART)
FIG. 1 is an exploded perspective view of a conventional vacuum cleaner including a suction extension pipe and a sub-suction pipe.

The air suction pipe 10 includes a hose 11 that is connected to the body 1 of the vacuum cleaner (see FIG. 1), and a handle portion 13 that is connected to the hose 11. The hose 11 is made of a flexible material, such as a rubber, etc., and connects the handle portion 13 to the vacuum cleaner body 1. The handle portion 13 includes a handle 13*a*, which a user can grasp to direct the appropriate brush of the vacuum cleaner across a cleaning surface. A drive switch 13*c* is formed on the handle 13*a* to turn on/off the vacuum cleaner. The handle portion 13, which further includes a pipe type connecting portion 13*b*, is preferably formed of plastic.

Figure 3:
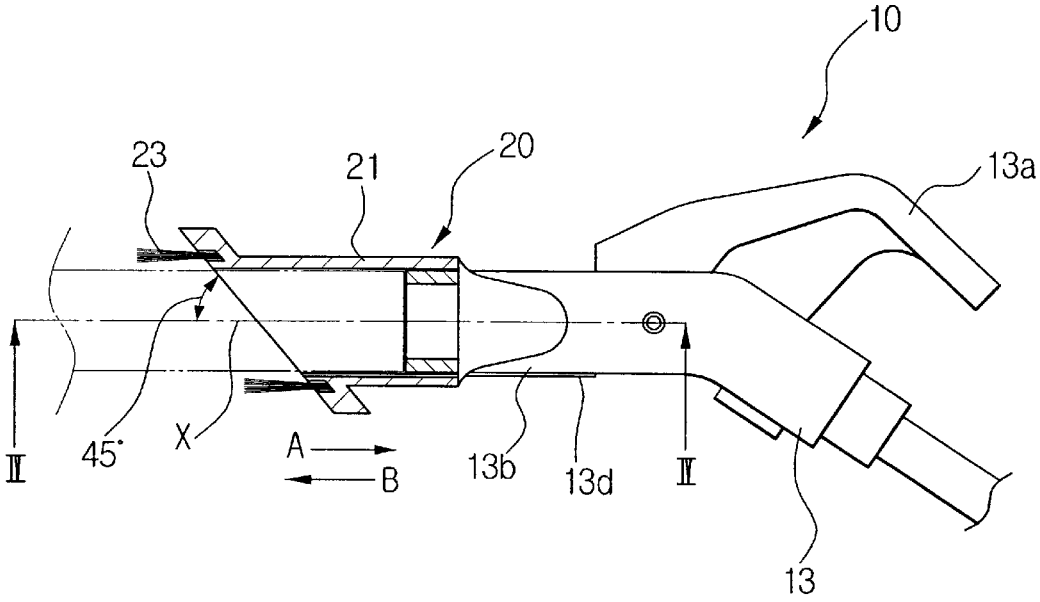
FIG. 3 is a partial cross-sectional view taken generally along the line III—III of FIG. 2.
Figure 4:
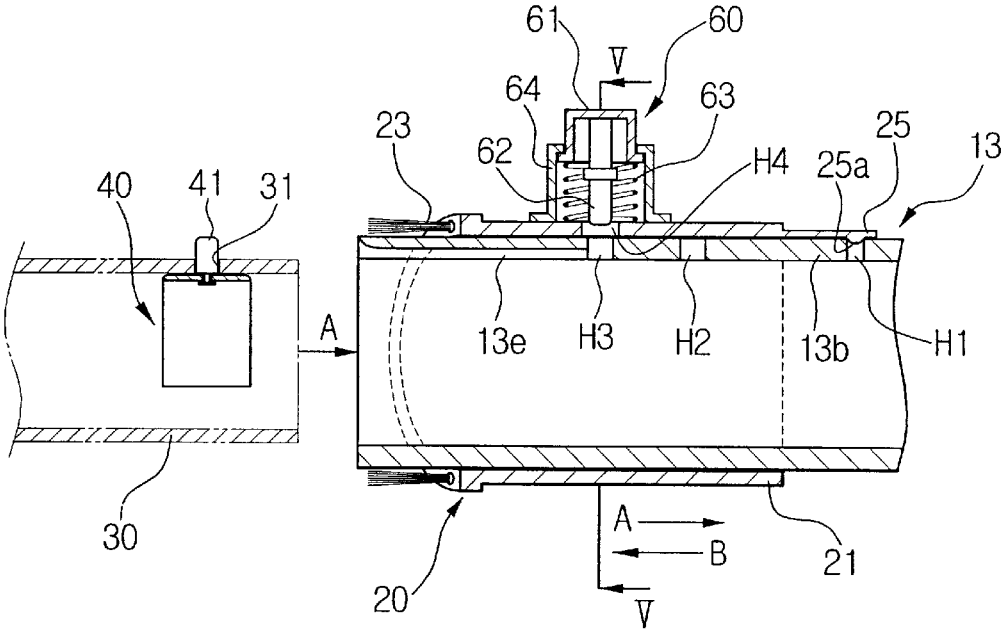
FIG. 4 is a cross-sectional view taken generally along the line IV—IV of FIG. 3.

The sub-suction pipe 20 is provided for cleaning a small or narrow surface area, such as a niche, table, cupboard, etc., or an area at a certain height from a floor. As shown in FIGS. 3 and 4, the sub-suction pipe 20 is movably connected to the connecting portion 13*b* of the handle portion 13. The sub-section pipe 20 slides over the connecting portion 13*b*, such that the two overlap by a certain distance. In order to clean using the sub-suction pipe 20, a user advances the sub-suction pipe 20 in a direction indicated by an arrow B in FIG. 3 over the connecting portion 13*b*. On the other hand, in order to store the sub-section pipe 20 and use the suction extension pipe 30, the user retracts the sub-suction pipe 20, by sliding it in a direction indicated by an arrow A in FIG. 3.

The sub-suction pipe 20 includes a pipe type suction pipe body 21, a brush 23 mounted on a leading end of the suction pipe body 21, and an elastic support portion 25, which extends from a rear end of the suction pipe body 21. The leading end of the sub-suction pipe 20 is formed at a predetermined sloping angle, preferably at 45°, with respect to an axis X of the air suction port. It is further preferable that the end of the brush 23 that is attached to the suction pipe body 21 is at the same angle as the suction pipe body 21. The elastic supporting portion 25 elastically supports an outer wall or circumference of the connecting portion 13*b* and generates a frictional force between the sub-suction pipe 20 and the connecting portion 13*b*. Further, as illustrated in FIG. 4, the elastic supporting portion 25 includes a protrusion 25*a* that is selectively inserted into insertion holes H1 and H2 formed in the connecting portion 13*b*. That is, by retracting the suction pipe body 21 in the direction indicated by the arrow A, the protrusion 25*a* is received in the insertion hole H1. Then by advancing the suction pipe body 21 in the direction indicated by arrow B, the protrusion 25*a* is received in the insertion hole H2. As described, the protrusion 25*a* is inserted in either one of the inserting holes H1 and H2, and accordingly prevents a movement of the sub-suction pipe 20.

Figure 5:
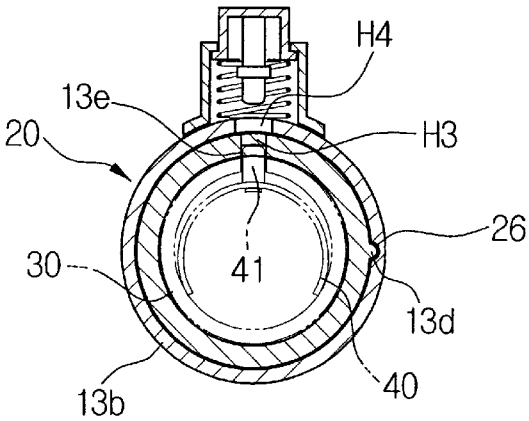
FIG. 5 is a cross-sectional view taken generally along the line V—V of FIG. 4.

A rotation preventing means is provided to prevent rotation of the sub-suction pipe 20 with respect to the connecting portion 13*b*. The rotation preventing means further acts to guide movement of the sub-suction pipe 20. As shown in FIG. 5, the rotation preventing means includes a guide protrusion 13*d*, and a guide groove 26 for receiving the guide protrusion 13*d*. The guide protrusion 13*d* extends from the outer wall of the connecting portion 13*b*, and the guide groove 26 is formed in an inner wall or circumference of the sub-suction pipe 20. Alternatively, the guide protrusion may be formed on the inner wall of the sub-suction pipe 20 and the guide groove formed in the outer wall of the connecting portion 13*b*.

The suction extension pipe 30 is removably mounted to the connecting portion 13*b* of the handle portion 13 of the air suction pipe 10. Accordingly, an outer diameter of the suction extension pipe 30 corresponds to an inner diameter of the sub-suction pipe 20. One end of the suction extension pipe 30 is connected to a suction brush 50 (see FIG. 2), which draws in foreign substances, such as dust, on the cleaning surface into the vacuum cleaner.

A locking/unlocking means locks or unlocks the suction extension pipe 30 with respect to the air suction pipe 10. The locking/unlocking means includes a plate spring 40 disposed in the suction extension pipe 30, a locking hole H3 formed in the connecting portion 13*b* of the air suction pipe 10, a release button 60 movably disposed on the sub-suction pipe 20, and a spring 63. The plate spring 40 is disposed along an inner wall or circumference of the suction extension pipe 30 and has a locking protrusion 41. The locking protrusion 41 projects out of the suction extension pipe 30 through a passing hole 31 formed therein. The elastic plate spring 40 deforms or recovers as the locking protrusion 41 moves in the passing hole 31. The locking hole H3 of the connecting portion 13*b* receives the locking protrusion 41, when the suction extension pipe 30 is inserted into the connecting portion 13*b*. Accordingly, when the locking protrusion 41 is engaged with the locking hole H3, the suction extension pipe 30 cannot be separated from the air suction pipe 10.

The sub-suction pipe 20 also includes passing hole H4. The passing hole H4 is in alignment with the locking hole H3, when the sub-suction pipe 20 is in its retracted position (e.g., when the protrusion 25*a* of the elastic supporting portion 25 of the sub-suction pipe 20 is in the insertion hole H1). The release button 60 is aligned with the passing hole H4 of the sub-suction pipe 20. The release button 60 includes a button portion 61 and a release bar 62 extending from the button portion 61 to the locking hole H3. The button portion 61 is movably mounted in a connecting portion 64, which is mounted on an outer wall or circumference of the suction pipe body 21. A spring 63 is disposed in the connecting portion 64. The spring 63 biases the release button 60 outward, such that the release bar 62 of the release button 60 does not extend into the locking hole H3. When a user depresses the button portion 61, the release bar 62 passes through the passing hole H4 and into the locking hole H3. There, the release bar 62 pushes the locking protrusion 41 out of the locking hole H3, enabling the user to detach the suction extension pipe 30 from the air suction pipe 10.

In addition, the vacuum cleaner includes an aligning means to align the locking protrusion 41 with the locking hole H3 as the suction extension pipe 30 is inserted in the connecting portion 13*b*. The aligning means includes an alignment groove 13*e* formed in the inner wall of the connecting portion 13*b* and an alignment protrusion, i.e., the locking protrusion 41, that is received in the alignment groove 13*e*. The alignment groove 13*e* extends from one end of the connecting portion 13*b* to the locking hole H3. When the suction extension pipe 30 is inserted in the connecting portion 13*b*, the locking protrusion 41 slides along the alignment groove 13*e*. When the locking protrusion 41 reaches the locking hole H3, the plate spring 40 biases the locking protrusion 41 into engagement with the locking hole H3.

Although the locking protrusion 41 serves as the aligning protrusion in this embodiment, it is only one example. Another possibility is to include a plurality of alignment grooves in the connecting portion 13*b* with corresponding alignment protrusions on the suction extension pipe 30.

Use of the sub-suction pipe assembly for the vacuum cleaner, in accordance with one preferred embodiment of the present invention will be described below.

First, in order to clean a small or narrow area, such as a niche, table, or the like, the sub-suction pipe 20 is used. Accordingly, as shown in FIG. 3, the suction extension pipe 30 is detached from the connecting portion 13*b*, and the sub-suction pipe 20 is advanced in the direction indicated by the arrow B until the protrusion 25*a* of the elastic supporting portion 25 engages the inserting hole H2. With the sub-suction pipe 20 in its extended state, the user can remove foreign substances, such as dust, etc., from the surface of a desk or wall. The foreign substances are drawn into the cleaner body 1 through the air suction portion of the sub-suction pipe 20.

Figure 6:
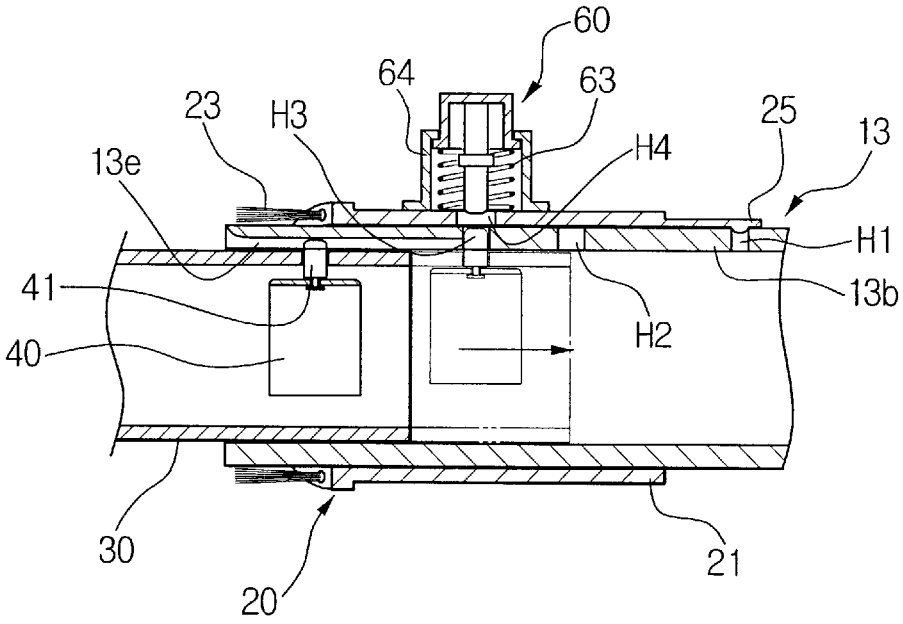
FIG. 6 is a partial cross-sectional view showing an air suction pipe connected to the suction extension pipe.

In order to use the suction brush 50 of FIG. 2, the user retracts the sub-suction pipe 20 in the direction indicated by the arrow A, until the protrusion 25*a* engages the inserting hole H1. Accordingly, as shown in FIG. 4, the protrusion 25*a* of the elastic supporting portion 25 is inserted in the inserting hole H1, securing the position of the sub-suction pipe 20. Then, as shown in FIG. 5, the user aligns the locking protrusion 41 with the alignment groove 13*e*. In this state, the user can then move the suction extension pipe 30 in the direction indicated by the arrow A in FIG. 4, into the connecting portion 13*b*. As shown in solid line of FIG. 6, the alignment groove 13*e* depresses the locking protrusion 41. Once the suction extension pipe 30 is fully inserted in the direction indicated by arrow A to the position indicated by the dashed line in FIG. 6, the locking protrusion 41 extends outward into the inserting hole H3. With the locking protrusion 41 in engagement with the locking hole H3, the connection between the connecting portion 13*b* with the suction extension pipe 30 is secure. In this state, the user can use the suction brush 5 to vacuum a large cleaning surface, such as a floor or the like.

As described above, unlike a conventional vacuum cleaner, the suction extension pipe 30 of the present invention is directly connected to the handle portion 13 at the same time that the sub-suction pipe 20 is connected to the handle portion 13. Accordingly, any inconvenience in having to remove and store the sub-suction pipe 20 in a separate place is eliminated.

Figure 7:
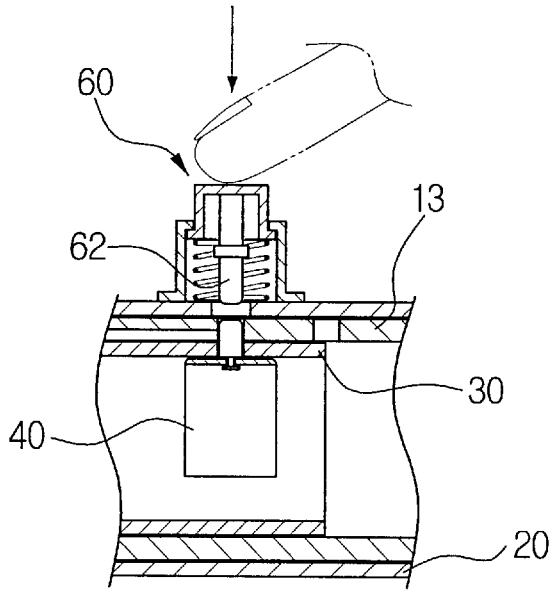
FIG. 7 is a partial cross-sectional view showing a locking protrusion engaged in a locking hole.
Figure 8:
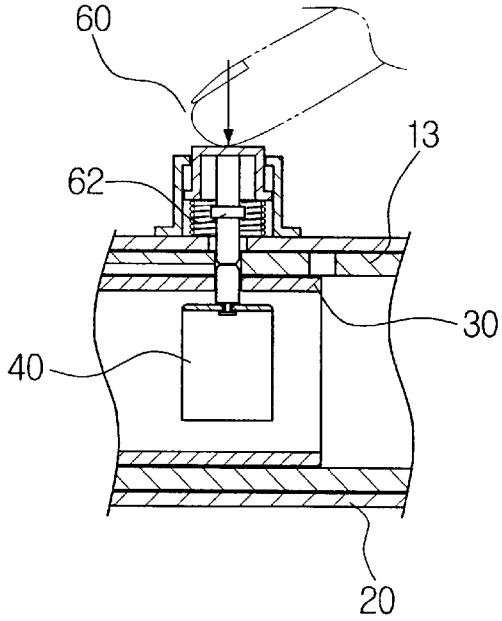
FIG. 8 is a partial cross-sectional view showing a release button of FIG. 7 being depressed.
Figure 9:
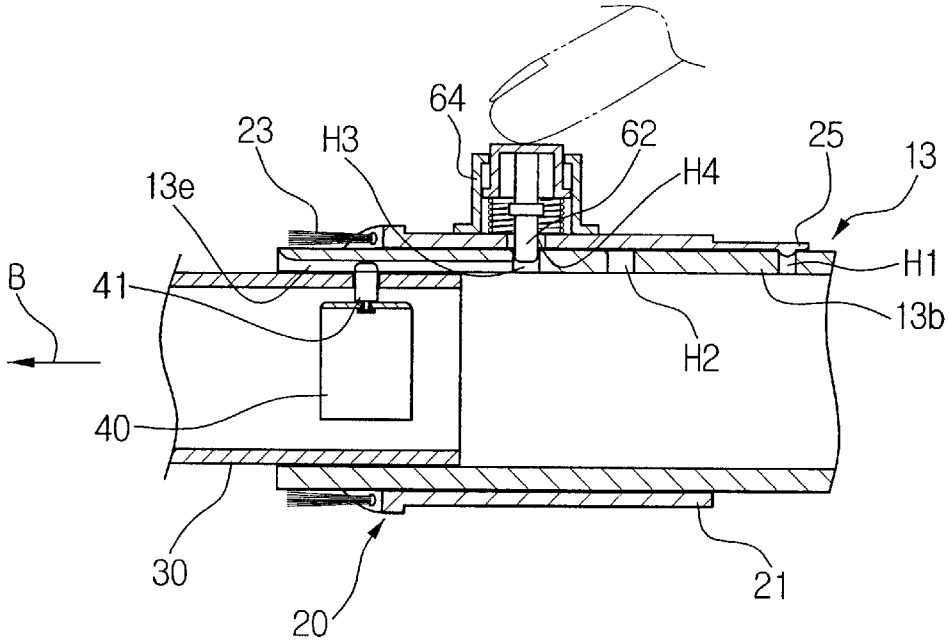
FIG. 9 is a partial cross-sectional view showing the suction extension pipe being separated from the air suction pipe, while the release button is depressed.

The process of detaching the suction extension pipe 30 from the sub-suction pipe 20 is shown in FIGS. 7–9. The user first presses down on the release button 60. As the release button 60 is depressed, the release bar 62 is passes through the passing hole H4 and into the locking hole H3. There, the release bar 62 pushes the locking protrusion 41 out of the locking hole H3. The suction extension pipe 30 can then be moved in the direction indicated by the arrow B in FIG. 9 to disconnect the suction extension pipe 30 from the connecting portion 13*b*.

Figure 10:
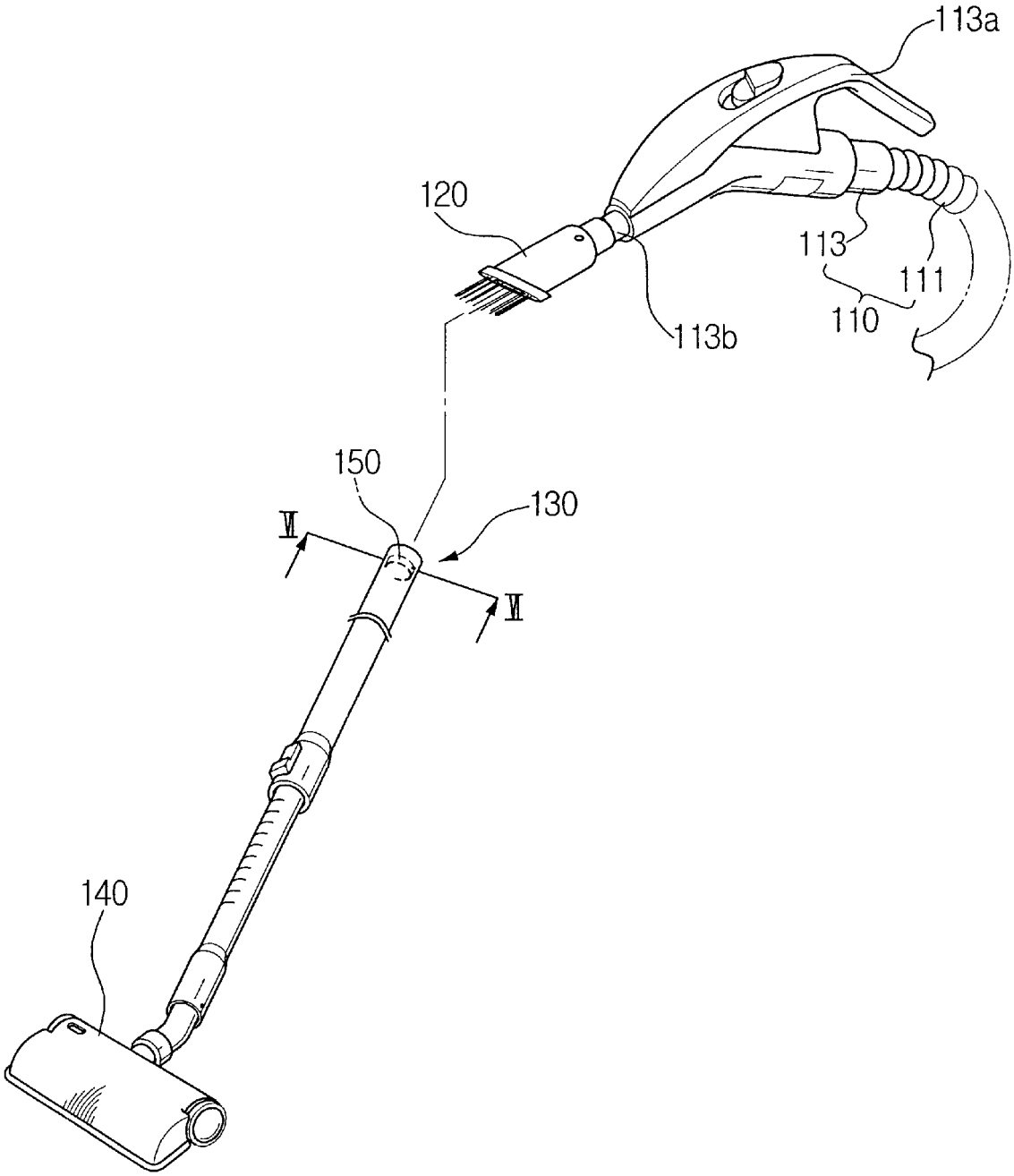
FIG. 10 is an exploded perspective view of a sub-suction pipe assembly of a vacuum cleaner in accordance with another preferred embodiment of the present invention.
Figure 11:
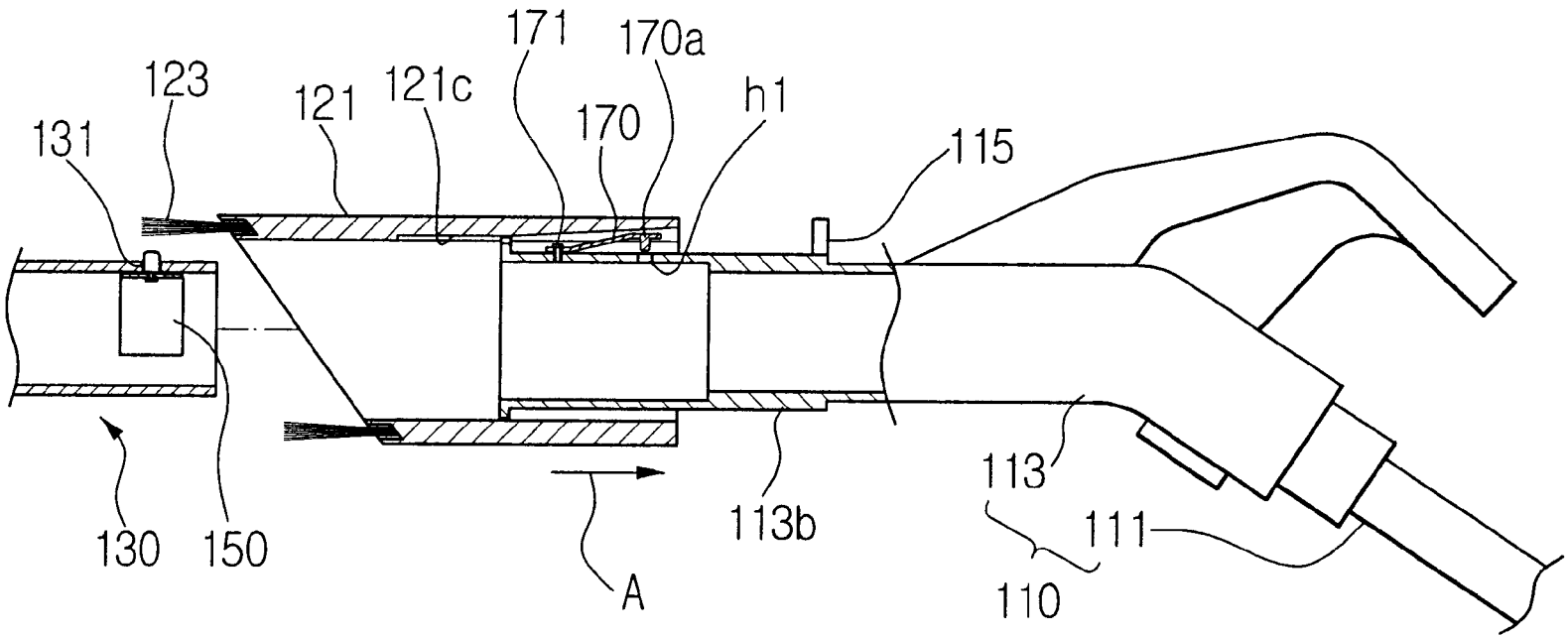
FIG. 11 is a partial sectional view of the sub-suction pipe assembly of FIG. 10.

Referring now to FIGS. 10 and 11, a brush assembly for a vacuum cleaner according to another preferred embodiment of the present invention is shown. The brush assembly includes an air suction pipe 110, a sub-suction pipe 120 movably connected to an end of the air suction pipe 110, a suction extension pipe 130, and a locking/unlocking means.

The air suction pipe 110 includes a hose 111 that is connected to the cleaner body 1 (see FIG. 1), and a handle portion 113 that is connected to the hose 111. The handle portion 113 includes a handle 113*a* and a pipe type connecting portion 113*b*, which is connected to the handle 113*a*. The connecting portion 113*b* can be separately manufactured and connected to the handle 113*a*.

The sub-suction pipe 120 surrounds an outer wall or circumference of the connecting portion 113*b* and reciprocates with respect to the connecting portion 113*b* by a certain distance. The sub-suction pipe 120 includes a suction pipe body 121 and a brush 123, which is provided at one end of the suction pipe body 121. Here, the brush 123 is formed at a predetermined angle.

Figure 12:
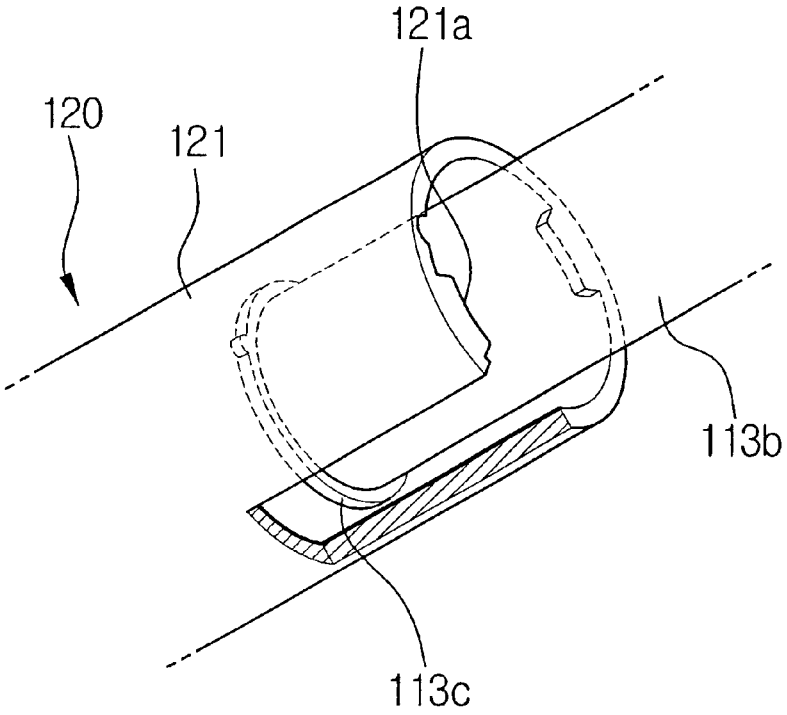
FIG. 12 is a partial perspective view showing the sub-suction pipe and the air suction pipe being connected together.

Referring to FIG. 12, the connecting portion 113*b* and the sub-suction pipe 120 include first and second locking elevations 113*c* and 121*a*, respectively, for preventing separation of the sub-suction pipe 120 from the connecting portion 113*b*. The first locking elevation 113*c* is formed at an open end of the connecting portion 113*b* as an extension of the outer wall, such as a flange. The second locking elevation 121*a*, which corresponds to the first locking elevation 113*c*, protrudes from an inner wall or circumference of the connecting end of the suction pipe body 121. A plurality of second elevations 121*a* are formed on the inner wall of the suction pipe body 121 in a non-continuous pattern. Further, a third locking elevation 115 (FIG. 11) protrudes from the outer circumference of the connecting portion 113*b* to limit movement of the sub-suction pipe 120 in the direction indicated by the arrow A. The third locking elevation 115 has a height approximately equal to a thickness of the suction pipe body 121. The third locking elevation 115 is preferably made of a plastic and bonded to the connecting portion 113*b*. Alternatively, the third locking elevation 115 may be integrally formed with the connecting portion 113*b*.

Figure 13:
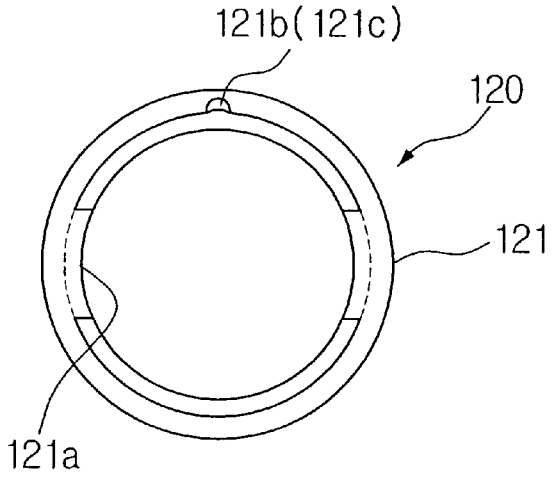
FIG. 13 is a front sectional view showing an end of the sub-suction pipe.
Figure 14:
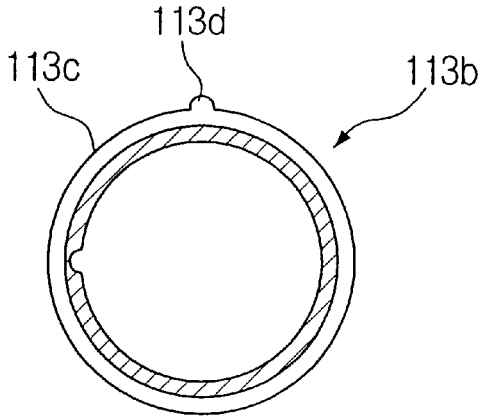
FIG. 14 is a sectional view of the air suction pipe of FIG. 10.

In addition, a rotation limiting means is provided to prevent rotation of the sub-suction pipe 120 with respect to the connecting portion 113*b*. As shown in FIGS. 13 and 14, the rotation limiting means includes a locking protrusion 113*d* that extends from an outer circumference of the first locking elevation 113*c*, and a rotation prevention groove 121*b* that is formed in an inner wall or circumference of the suction pipe body 121 and corresponding to the locking protrusion 113*d*. The rotation prevention groove 121*b* extends lengthwise a certain distance along the suction pipe body 121. In addition, the rotation prevention groove 121*b* slopes in the lengthwise direction of the suction pipe body 121, such that the groove 121*b* is deepest at the end of the connecting portion 113*b* and becomes more shallow as it approaches the center of the connecting portion 113*b*. The rotation prevention groove 121*b* will hereinafter be referred to as a "sloping groove."

Since the construction of the suction extension pipe 130 is identical that of the suction extension pipe 30 shown in FIG. 2, its description will be omitted.

Figure 15:
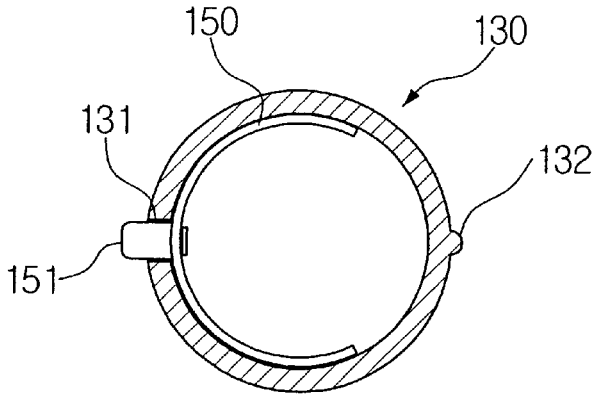
FIG. 15 is a cross-sectional view taken generally along the line VI—VI of FIG. 10.

As illustrated in FIG. 11, the locking/unlocking means includes a plate spring 150 disposed in the suction extension pipe 130, a locking hole hl formed in the connecting portion 113*b* of the air suction pipe 110, and an elastic piece 170 attached to the outer wall of the connecting portion 113*b*. As shown in FIG. 15, the plate spring 150 is disposed in the suction extension pipe 130, and has a locking protrusion 151, which is projects through the passing hole 131 of the suction extension pipe 130. The locking hole h1 is designed to receive the locking protrusion 151. When the suction extension pipe 130 is inserted in the connecting portion 113*b*, the locking protrusion 151 is inserted into and thus engaged with the locking hole h1.

The elastic piece 170 includes a fixed end that is secured by a fixing pin 171 to the outer wall of the connecting portion 113*b*. The elastic piece 170 further includes a free end that extends from the fixed end and is elastically deformable. A release protrusion 170*a* extends from the free end of the elastic piece 170. The release protrusion 170*a* is adapted to fit into the locking hole h1. The elastic piece 170 is elastically deforms when it contacts the sloping groove 121*c* (FIG. 11). When the sub-suction pipe 120 moves in the direction indicated by arrow A of FIG. 11, the elastic piece 170 is pressed within the shallow (e.g., vertically narrower) part of the sloping groove 121*c*, and accordingly, the release protrusion 170*a* of the elastic piece 170 is inserted into the locking hole h1.

Figure 16:
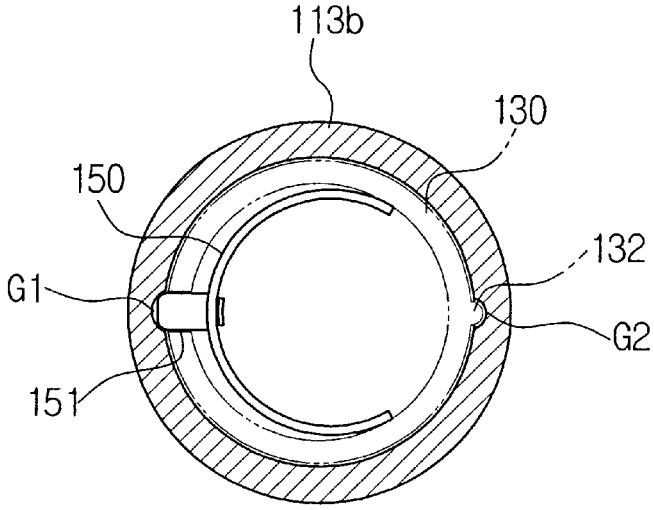
FIG. 16 is a cross-sectional view showing the air suction pipe in connection with the suction extension pipe.

Additionally, an aligning means is provided to align the locking hole h1 with the locking protrusion 151 during connection of the air suction pipe 110 and the suction extension pipe 130. As shown in FIG. 16, the aligning means includes a guide groove G1 that extends lengthwise along the inner wall of the connecting portion 113*b* toward the locking hole h1.

The aligning means includes a guide protrusion 132 and a guide groove G2 that corresponds with the guide protrusion 132. The guide protrusion 132 projects from the outer wall of the suction extension pipe 130, and the guide groove G2 is formed in the inner wall of the connecting portion 113*b* of the air suction pipe 110. Alternatively, the guide protrusion may extend from the inner wall of the connecting portion 113*b*, and the guide groove may be formed in the outer wall of the suction extension pipe 130.

Use of the sub-suction pipe assembly for the vacuum cleaner, in accordance with the second preferred embodiment of the present invention will be described below.

Figure 17:
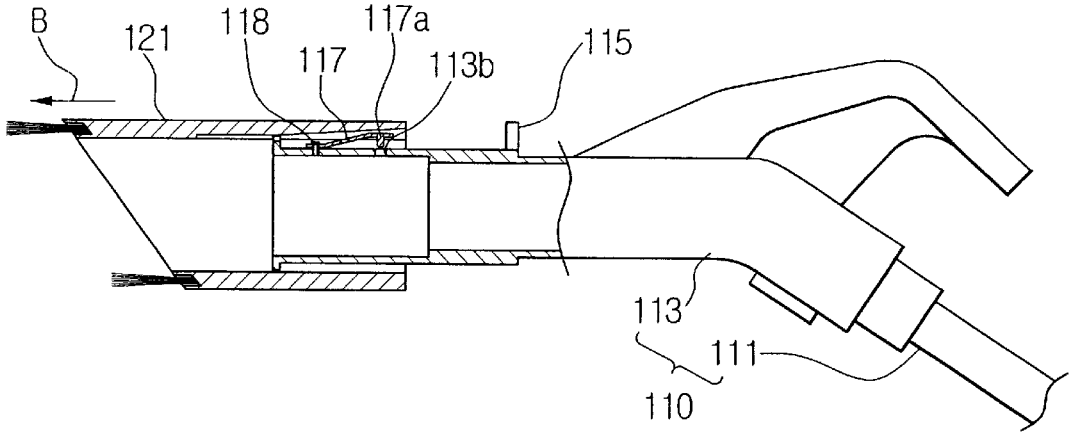
FIG. 17 is a partial sectional view showing the air suction pipe, with the suction extension pipe removed from the air suction pipe.

First, in order to use the sub-suction pipe 120, the suction extension pipe 130 is separated from the rest of the vacuum cleaner. The user then moves the sub-suction pipe 120 in the direction indicated by arrow A of FIG. 11 until the sub-suction pipe 120 contacts the third locking elevation 115. Then, as shown in FIG. 17, the sub-suction pipe 120 is connected to the connecting portion 113*b* and surrounds the outer circumference of the connecting portion 113*b*, contacting the third locking elevation 115. The return force of the elastic piece 170 restricts movement of the sub-suction pipe 120. Further, since the first locking elevation 113*c* is inserted in the sloping groove 121*c*, rotation of the sub-suction pipe 120 is also prevented.

In order to use the suction brush 140, the user moves the sub-suction pipe 120 in the direction indicated by the arrow B in FIG. 17. Accordingly, as shown in FIG. 11, the elastic piece 170 recovers its original shape, and the release protrusion 170*a* is separated from the locking hole h1. The first locking elevation 113*a* is locked in the second locking elevation 121*a*. Accordingly, the sub-suction pipe 120 will not separate from the connecting portion 113*b*. In such a state, as shown in FIG. 16, the locking protrusion 151 of the suction extension pipe 130 is aligned with the first guide groove G1. Then, the suction extension pipe 130 is moved in the direction indicated by the arrow A in FIG. 11 and inserted into the connecting portion 113*b*. The first guide groove G1 pushes down on the locking protrusion 151 to elastically deform the plate spring 150.

In such a state, the locking protrusion 151 is moved along the first guide groove G1, until it reaches the locking hole h1. At the locking hole h1, the plate spring 150 returns to its normal state to extend the locking protrusion 151 into the locking hole h1 (see FIG. 18). When the locking protrusion 151 is inserted in the locking hole h1, the suction extension pipe 130 is fixedly connected to the handle portion 113*b*. In such a state, the user can use the suction brush 140 to vacuum the cleaning surface.

As described above, the user does not need to detach the sub-suction pipe 120 from the connecting portion 113*b* in order to use the suction brush 140.

Figure 18:
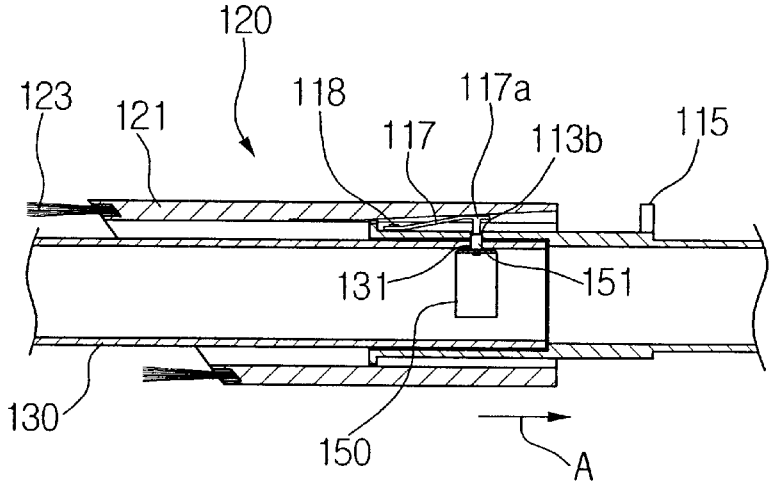
FIG. 18 is a partial cross-sectional view showing the suction extension pipe connected to the air suction pipe.

In order to separate the suction extension pipe 130 from the connecting portion 113*b*, the sub-suction pipe 120 is moved in the direction indicated by the arrow A in FIG. 18. The elastic piece 170 is pressed within a vertically narrower part of the sloping groove 121*c*.

Figure 19:
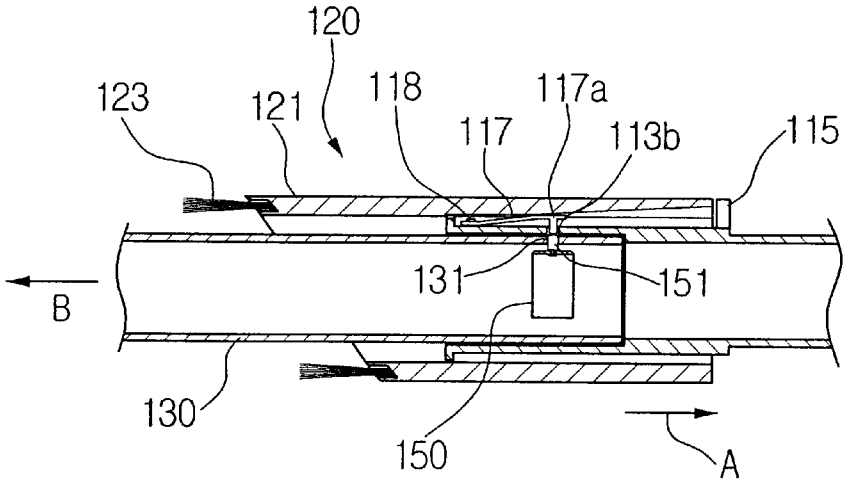
FIG. 19 is a partial cross-sectional view showing the locking protrusion disengaged from the locking hole.

When the elastic piece 170 is pressed, the releasing protrusion 170*a* is inserted in the locking hole h1 (see FIG. 19), pushing the locking protrusion 151 out of engagement with the locking hole h1. The locking protrusion 151 is then separated from the locking groove h1, by moving the suction extension pipe 130 in the direction indicated by the arrow B in FIG. 19 to detach the suction extension pipe 130.

As described above, according to the sub-suction pipe assembly of the present invention, since the sub-suction pipe 120 is movably connected to the connecting portion 113*b*, and there is no need to separate the sub-suction pipe 120 from the vacuum cleaner and store it in a separate place, when the sub-suction pipe 120 is not being used.

In addition, the sub-suction pipe assembly of the present invention has a much simpler structure, facilitating connection and separation of the suction extension pipe 130 to and from the vacuum cleaner body 1.

As stated above, preferred embodiments of the present invention are shown and described. Although the preferred embodiments have been described, it is understood that the present invention should not be limited to these preferred embodiments. Various changes and modifications can be made by one skilled in the art within the spirit and scope of the present invention as hereinafter claimed.

What is claimed is:

1. A sub-suction pipe assembly for a vacuum cleaner having a vacuum cleaner body, the sub-suction pipe assembly comprising:

an air suction pipe connected to the vacuum cleaner body;

a sub-suction pipe movably connected to the air suction pipe, the sub-suction pipe being movable with respect to an end of the air suction pipe, the sub-suction pipe having a brush attached to an end thereof;

a suction extension pipe detachably connected to the end of the air suction pipe; and locking/unlocking means for locking and unlocking the suction extension pipe with respect to the air suction pipe, wherein the sub-suction pipe remains connected to the air suction pipe when the suction extension pipe is connected to the air suction pipe, wherein the sub-suction pipe comprises an elastic connecting portion connected to an outer wall of the air suction pipe, the elastic connecting portion generating a friction force between the air suction pipe and the sub-suction pipe to restrict movement of the sub-suction pipe.

2. The assembly as claimed in claim 1, wherein the locking/unlocking means comprises:

a plate spring disposed in the suction extension pipe, the plate spring having a locking protrusion protruding from an outer wall of the suction extension pipe through a passing hole formed in the suction extension pipe;

a locking hole formed in the air suction pipe for receiving the locking protrusion;

a release button mounted on the sub-suction pipe for removing the locking protrusion from the locking hole; and a spring coupled to the release button to bias the release button away from the locking hole.

3. The assembly as claimed in claim 2, further comprising aligning means for aligning the locking hole of the air suction pipe with the locking protrusion of the suction extension pipe.

4. The assembly as claimed in claim 3, wherein the aligning means comprises an alignment groove formed lengthwise in an inner wall of the air suction pipe, and an alignment protrusion extending from the outer wall of the suction extension pipe, the alignment protrusion being received in the alignment groove when the suction extension pipe is aligned with the air suction pipe.

5. The assembly as claimed in claim 1, further comprising rotation preventing means for guiding the sub-suction pipe along the air suction pipe and preventing rotation of the sub-suction pipe.

6. The assembly as claimed in claim 5, wherein the rotation preventing means comprises a guide protrusion protruding from the outer wall of the air suction pipe, and a guide groove formed in an inner wall of the sub-suction pipe.

7. The assembly as claimed in claim 1, wherein the elastic connecting portion includes a protrusion, and wherein a plurality of inserting holes are formed in the outer wall of the air suction pipe, the protrusion being selectively received in one of inserting holes in the air suction pipe to restrict movement of the sub-suction pipe.

8. The assembly as claimed in claim 1, wherein the brush of the sub-suction pipe is at a predetermined angle with respect to a central axis of the sub-suction pipe.

9. The assembly as claimed in claim 1, wherein the air suction pipe comprises:

a handle portion having a connecting portion which is movably connected to the sub-suction pipe; and a flexible hose portion connecting the handle portion and the cleaner body.

10. The assembly as claimed in claim 1, wherein the locking/unlocking means comprises:

a plate spring disposed in the suction extension pipe, the plate spring having a locking protrusion protruding from an outer wall of the suction extension pipe through a passing hole formed in the suction extension pipe;

a locking hole formed in the air suction pipe for receiving the locking protrusion; and an elastically deformable elastic portion disposed between the air suction pipe and the sub-suction pipe, the elastic portion having a release protrusion, the release protrusion being selectively inserted in the locking hole to disengage the locking protrusion from the locking hole.

11. The assembly as claimed in claim 10, wherein the sub-suction pipe has a sloping groove formed lengthwise along an inner wall of the sub-suction pipe at a predetermined angle, the elastic portion being elastically deformed by the sloping groove as the sub-suction pipe moves with respect to the air suction pipe.

12. The assembly as claimed in claim 1, wherein each of the air suction pipe and the sub-suction pipe comprises a locking elevation for engaging with each other to restrict movement and separation of the sub-suction pipe from the air suction pipe.

13. A sub-suction pipe assembly for a vacuum cleaner having a vacuum cleaner body, the sub-suction pipe assembly comprising:

an air suction pipe connected to the vacuum cleaner body;

a sub-suction pipe movably connected to the air suction pipe, the sub-suction pipe being movable with respect to an end of the air suction pipe, the sub-suction pipe having a brush attached to an end thereof;

a suction extension pipe detachably connected to the end of the air suction pipe; and locking/unlocking means for locking and unlocking the, suction extension pipe with respect to the air suction pipe, wherein the sub-suction pipe remains connected to the air suction pipe when the suction extension pipe is connected to the air suction pipe;

wherein the locking/unlocking means comprises:

a plate spring disposed in the suction extension pipe, the plate spring having a locking protrusion protruding from an outer wall of the suction extension pipe through a passing hole formed in the suction extension pipe;

a locking hole formed in the air suction pipe for receiving the locking protrusion;

an elastically deformable elastic portion disposed between the air suction pipe and the sub-suction pipe, the elastic portion having a release protrusion, the release protrusion being selectively inserted in the locking hole to disengage the locking protrusion from the locking hole.

14. The assembly as claimed in claim 13, wherein the sub-suction pipe has a sloping groove formed lengthwise along an inner wall of the sub-suction pipe at a predetermined angle, the elastic portion being elastically deformed by the sloping groove as the sub-suction pipe moves with respect to the air suction pipe.

15. A sub-suction pipe assembly for a vacuum cleaner having a vacuum cleaner body, the sub-suction pipe assembly comprising:

an air suction pipe connected to the vacuum cleaner body;

a sub-suction pipe movably connected to the air suction pipe, the sub-suction pipe being movable with respect to an end of the air suction pipe, the sub-suction pipe having a brush attached to an end thereof;

a suction extension pipe detachably connected to the end of the air suction pipe; and locking/unlocking means for locking and unlocking the suction extension pipe with respect to the air suction pipe, wherein the sub-suction pipe remains connected to the air suction pipe when the suction extension pipe is connected to the air suction pipe, wherein the brush has a face which forms an acute angle with the sub-suction pipe.

* * * * *